US008282796B2

(12) United States Patent
Tao et al.

(10) Patent No.: US 8,282,796 B2
(45) Date of Patent: Oct. 9, 2012

(54) CARBONACEOUS SUBSTRATE AND ELECTRODE FOR FLUORINE-PRODUCING ELECTROLYSIS

(75) Inventors: Rie Tao, Osaka (JP); Takanori Kawano, Osaka (JP); Yoshio Shodai, Osaka (JP)

(73) Assignee: Toyo Tanso Co., Ltd., Osaka-shi (JP)

( * ) Notice: Subject to any disclaimer, the term of this patent is extended or adjusted under 35 U.S.C. 154(b) by 155 days.

(21) Appl. No.: 12/679,114

(22) PCT Filed: Sep. 19, 2008

(86) PCT No.: PCT/JP2008/067021

§ 371 (c)(1), (2), (4) Date: Mar. 19, 2010

(87) PCT Pub. No.: WO2009/038192

PCT Pub. Date: Mar. 26, 2009

(65) Prior Publication Data

US 2010/0252425 A1 Oct. 7, 2010

(30) Foreign Application Priority Data

Sep. 20, 2007 (JP) ..... 2007-244557

(51) Int. Cl.
*C25B 11/12* (2006.01)
*H01M 4/96* (2006.01)
*C01B 31/02* (2006.01)

(52) U.S. Cl. ..... 204/294; 502/101; 423/445 R; 423/445 B; 423/446; 423/448; 423/460; 252/500; 252/502; 252/504; 252/516

(58) Field of Classification Search ..... 204/294; 313/311; 502/101; 423/445 R, 445 B, 446, 423/448, 460; 252/500, 502, 504, 516
See application file for complete search history.

(56) References Cited

U.S. PATENT DOCUMENTS

| | | | | |
|---|---|---|---|---|
| 7,858,551 | B2 * | 12/2010 | Takasu et al. | 502/101 |
| 2006/0066203 | A1 * | 3/2006 | Uno et al. | 313/311 |
| 2006/0219570 | A1 | 10/2006 | Furuta et al. | |
| 2008/0314759 | A1 * | 12/2008 | Furuta et al. | 205/556 |
| 2009/0324810 | A1 * | 12/2009 | Serikawa et al. | 427/78 |
| 2010/0193371 | A1 * | 8/2010 | Tasaka et al. | 205/460 |

FOREIGN PATENT DOCUMENTS

| | | |
|---|---|---|
| EP | 0 354 057 | 2/1990 |
| EP | 0 442 644 | 8/1991 |
| JP | 2 47297 | 2/1990 |
| JP | 5 5194 | 1/1993 |
| JP | 8-78010 | 3/1996 |
| JP | 2000 200603 | 7/2000 |
| JP | 2006 97054 | 4/2006 |
| JP | 2006 249557 | 9/2006 |

OTHER PUBLICATIONS

Extended Search Report issued Jan. 20, 2011 in Europe Application No. 08831970.2.

Office Action issued Jul. 6, 2011 in Chinese Patent Application No. 200880108121.0 (with English translation).

European Office Action issued Jan. 19, 2012 in patent application No. 08 831 970.2.

* cited by examiner

*Primary Examiner* — Bruce Bell
(74) *Attorney, Agent, or Firm* — Oblon, Spivak, McClelland, Maier & Neustadt, L.L.P.

(57) ABSTRACT

A carbonaceous substrate of the present invention is such that an X-ray diffraction pattern thereof is a complex profile and includes at least two (002) diffraction lines; and the substrates contains crystallites with different interlayer spacings. Further, in the X-ray diffraction pattern, (002) diffraction lines between 2θ=10° and 2θ=30° have an asymmetric shape; and the X-ray diffraction pattern includes at least two pattern components which are a diffraction line whose center is at 2θ=26° and a diffraction line whose center is at a lower angle than 2θ=26°. Further, the carbonaceous substrate contains crystals wherein the periodic distance $d_{002}$ is 0.34 nm or more and the crystallite size $Lc_{002}$ is 20 nm or less based on the X-ray diffraction lines. An electrodes for fluorine electrolysis of the present invention includes the carbonaceous substrate on which a conductive diamond thin film is formed.

13 Claims, No Drawings

CARBONACEOUS SUBSTRATE AND ELECTRODE FOR FLUORINE-PRODUCING ELECTROLYSIS

TECHNICAL FIELD

The present invention relates to: a carbonaceous substrate which, when contacting fluorine or fluoride, is hardly intercalated and is suitable for formation of a diamond thin film; and an electrode for fluorine electrolysis, which is usable in an electrolytic method adopting an electrolyte containing fluoride ion. In particular, the present invention relates to electrodes for fluorine electrolysis, each of which has a diamond structure, restrains an anode effect even in operations with a high electric current density, produces less sludge due to wear of the electrodes, produces less carbon tetrafluoride gas, and enables continuation of stable electrolysis.

BACKGROUND ART

For the chemical stability, electrodes using a carbonaceous substrate have been suitably adopted as an electrolyte for containing fluoride ion electrolysis.

Patent Documents 1 and 2 each describes an exemplary carbon electrode used for synthesizing a fluorine-containing material through electrolysis using an electrolyte containing fluoride ion. Similarly, electrolysis for producing fluorine gas also uses a carbon electrode. The market and uses of fluorine gas are expected to grow significantly in a semiconductor field, as a cleaning gas, an etching gas, or a gas for reforming surfaces of plastic materials. Production of a large amount of fluorine gas with a high electric current density is crucial. However, a carbon electrode polarizes due to an anode effect. For this reason, use of a carbon electrode makes an operation with a high electric current density difficult sometimes.

To solve the above problem, a carbon electrode is coated with conductive diamond which is chemically stable and has a wide potential window. Use of this electrode enables an electrolysis operation with a high electric current density. Further, highly efficient and stable synthesis of fluorine compound is possible for a long time. Such an electrode is disclosed in Patent Documents 3 and 4.

[Patent Document 1] Japanese Unexamined Patent Publication No. 047297/02 (Tokukaihei 02-047297)

[Patent Document 2] Japanese Unexamined Patent Publication No. 005194/05 (Tokukaihei 05-005194)

[Patent Document 3] Japanese Unexamined Patent Publication No. 249557/2006 (Tokukai 2006-249557)

[Patent Document 4] Japanese Unexamined Patent Publication No. 097054/2006 (Tokukai 2006-097054)

DISCLOSURE OF THE INVENTION

Technical Problem

However, when synthesizing a fluorine-containing material through an electrolysis using the carbonaceous substrate, a use of a typical carbonaceous substrate may cause intercalation attributed to structural disorder of the carbon crystal or infiltration of the electrolyte. This intercalation may deteriorate the property of the carbonaceous substrate or destroy the carbonaceous substrate itself. If diamond thin films are formed on this material, the expansion of the carbonaceous substrate may cause cracks or peeling of the thin films.

Further, when the coating is conductive diamond, the conductive diamond has polycrystalline structure and therefore causes difficulty in coating the entire substrate perfectly without even a small defect. An uncoated portion of the carbonaceous substrate may be intercalated due to development of the crystallinity, and the conductive diamond may be peeled due to infiltration of the electrolyte into the carbonaceous substrate.

In view of this, the present invention is made, and it is an object of the present invention to provide a carbonaceous substrate in which structural disorder of the carbon crystal due to intercalation or infiltration to the electrolyte are restrained, carbonaceous substrate being suitable for forming a diamond thin film, and an electrodes for a fluorine-producing electrolysis, which is coated with a conductive diamond having a good adhesiveness.

Technical Solution

A carbonaceous substrate of the present invention is such that, at the time of electrolysis of electrolyte containing fluoride ions, a graphite fluoride is formed in priority to formation of a charge-transfer type intercalation compound. Further, carbonaceous substrate, wherein: an X-ray diffraction pattern of the carbonaceous substrate is a complex profile and includes at least two (002) diffraction lines; and the substrates contains crystallites with different interlayer spacings. Particularly, in an X-ray diffraction pattern thereof, (002) diffraction lines between $2\theta=10°$ and $2\theta=30°$ have an asymmetric shape; and the X-ray diffraction pattern includes two pattern components which are a diffraction line whose center is at $2\theta=26°$ and a diffraction line whose center is at a lower angle than $2\theta=26°$. Further, in the carbonaceous substrate, it is preferable that the presence proportion of the diffraction line whose center is at the $2\theta=26°$ is 30% or more of the total surficial area of the (002) diffraction lines between $2\theta=10°$ and $2\theta=30°$. Further, the carbonaceous substrate contains crystals wherein the periodic distance $d_{002}$ is 0.34 nm or more and the crystallite size $Lc_{002}$ is 20 nm or less based on the X-ray diffraction lines. Further, the carbonaceous substrate is preferably an isotropic carbon material. Further, the carbonaceous substrate of the present invention is preferably manufactured through a cold isostatic pressing method, using mesophase microbeads as the filler. Additionally, the open porosity of the carbonaceous substrate is preferably between 5 to 30 volume %. When such a carbonaceous substrate is coated with a conductive diamond thin film and used as an electrode, tissue breakdown attributed to intercalation of fluorine ion will not take place in a portion without the diamond structure. Further, the surface is fluorinated and becomes electrochemically inertness. Since electrolysis only takes place on the conductive diamond thin film having the diamond structure, stable operation is possible for a long time.

An electrode of the present invention for a fluorine electrolysis includes the above mentioned carbonaceous substrate on which a conductive diamond thin film is formed. That is, it is preferable that a conductive diamond thin film is formed on a carbonaceous substrate wherein an X-ray diffraction pattern thereof is a complex profile and includes at least two (002) diffraction lines, the substrates containing crystallites with different interlayer spacings.

Further, it is preferable to coat, with a conductive diamond thin film, a carbonaceous substrate wherein, in an X-ray diffraction pattern thereof, (002) diffraction lines between $2\theta=10°$ and $2\theta=30°$ have an asymmetric shape; and the X-ray diffraction pattern includes at least two pattern components which are a diffraction line whose center is at $2\theta=26°$ and a diffraction line whose center is at a lower angle than $2\theta=26°$.

Further, the carbonaceous substrate coated with a conductive diamond thin film is preferably a substrate as follows. Specifically, the presence area of the diffraction line whose center is at the 2θ=26° is preferably 30% or more of a total surficial area of the (002) diffraction lines between 2θ=10° and 2θ=30°.

Further, it is preferable that the carbonaceous substrate contain crystals wherein the periodic distance $d_{002}$ is 0.34 nm or more and the crystallite size $Lc_{002}$ is 20 nm or less based on the X-ray diffraction lines.

Further, the carbonaceous substrate is preferably an isotropic carbon material.

Further, the carbonaceous substrate preferably contains mesophase microbeads as filler material.

Further, the open porosity of the carbonaceous substrate is preferably 5 to 30 volume %.

Further, the conductive diamond thin film preferably contains boron as a p-type dopant and nitrogen or phosphorous as an n-type dopant; and the content of the p-type dopant and/or the n-type dopant is preferably not more than 100,000 ppm.

Further, a film thickness of the conductive diamond thin film is preferably 0.5 μm or more but not more than 10 μm.

Further, 10% or more of the surface of the carbonaceous substrate is preferably coated with the conductive diamond thin film.

Further, the crystallinity of the conductive diamond thin film is preferably such that the lattice constant derived from the X-ray diffraction is 0.357 nm or less, and in Raman spectrum resulted from Raman spectroscopic analysis, the full width at half maximum of a peak between 1320 and 1340 $cm^{-1}$ of the C-C stretch mode of $SP^3$ bonding is 100 $cm^{-1}$ or less.

Effect of the Invention

With the present invention, a double-layered electrode in which a carbonaceous substrate is coated with a conductive diamond thin film is used as an anode for synthesizing a fluorine-containing material by an electrolytic method. The crystallinity of the carbonaceous substrate used in such an electrode is controlled so as to prevent structural disorder of the carbon crystal and/or infiltration of the electrolyte attributed to intercalation. As a result, stable synthesis of a fluorine compound with a high electric current density is possible without causing peeling of the conductive diamond thin film.

BEST MODE FOR CARRYING OUT THE INVENTION

The following describes a suitable embodiment of the present invention.

The following details an electrode of the present invention for synthesizing fluorine-containing material and a carbonaceous substrate used in the synthesis. The electrode in the present invention is manufactured by a crystallinity-adjusted carbonaceous substrate with a conductive diamond thin film having diamond structure.

In the electrode, the conductive diamond thin film is polycrystal. For this reason, it is difficult to completely coat with the conductive diamond thin film the whole substrate without defect. In view of this, in the present embodiment, a carbonaceous substrate is coated with chemically stable conductive diamond. Such a carbonaceous substrate, when immerged into an electrolyte which contains fluoride ion, prevents structural disorder of the carbon crystal and/or infiltration of the electrolyte which are caused by intercalation. Further, providing an insulation coating on the carbonaceous substrate enables the substrate to self-stabilize.

The carbonaceous substrate is such that, during an electrolysis using an electrolyte containing fluoride ion, a charge-transfer type intercalation compound forms before formation of graphite fluoride. An X-ray diffraction pattern of this carbonaceous substrate is a complex profile and includes at least two (002) diffraction lines; and the substrates contains crystallites with different interlayer spacings. Further, in the X-ray diffraction pattern, the (002) diffraction lines between 2θ=10° and 2θ=30° have an asymmetric shape; and the X-ray diffraction pattern includes at least two pattern components which are a diffraction line whose center is at 2θ=26° and a diffraction line whose center is at a lower angle than 2θ=26°. The presence area of the diffraction line whose center is at the 2θ=26° is 30% or more of a total surficial area of the (002) diffraction lines between 2θ=10° and 2θ=30°. With the crystal of carbon being intercalated with fluorine ion, polarization can be relatively restrained. Note that the presence proportion of the diffraction line whose center is at 2θ=26° is preferably 50% or more of the total surficial area of the (002) diffraction lines between 2θ=10° and 2θ=30°.

The carbonaceous substrate can be either unitary or binary, and is made of a carbonaceous material which is obtained by mixing, moulding and calcining one or two or more of the following raw materials (fillers): mesophase microbeads, coal pitch coke, petroleum pitch coke, coal coke, petroleum coke, coal tar, a high polymer compound such as phenol resin or the like. Moulding method may be carried on a cold isostatic pressing method, or an extrusion moulding method. However, it is preferable to adopt an isotropic carbon material moulded through a cold isostatic pressing method in which the physical property is not affected by the direction.

The open porosity of the substrate is 5 to 30 volume %, and is preferably 5 to 20 mass %. When the open porosity is less than 5 volume %, the anchor effect at the time of coating with the conductive diamond is not obtained. When the open porosity is more than 30 volume %, suitable density and strength of the carbonaceous substrate are not achieved. Therefore, when synthesizing a fluorine-containing material through electrolysis using an electrolyte containing fluoride ion, the fluorine ion intercalates between layers of carbon crystals. Further, the adopted carbonaceous substrate contains crystals wherein the periodic distance $d_{002}$ (i.e. interlayer spacing) is 0.34 nm or more and the crystallite size $Lc_{002}$ is 20 nm or less based on the X-ray diffraction lines. Due to the low crystallinity of the carbonaceous substrate having the above-described periodic distance and crystallite size, the periodic distance is not sufficient for fluorine to enter. Therefore, when such a carbonaceous substrate is used, intercalation hardly occurs as compared with a material such as a graphite having a developed crystallinity. Even if intercalation occurs, the periodic distance barely changes. Therefore, structural disorder is preventable.

An electrode in which the above carbonaceous substrate is coated with conductive diamond is used in synthesizing a fluorine-containing material. When such an electrode is used, a portion of the electrodes not having a diamond structure will not have tissue break down attributed to intercalation of fluorine ion. Further, fluorinating and forming an insulation coating on the surface of the electrode makes the electrode electrochemically inertness. The electrode is preferably (CF)n and electrochemically inertness. Therefore, the electrolysis occurs only on the conductive diamond thin film portion having a diamond structure. This enables stable operation for a long time.

Note that when the carbonaceous substrate adopted contains crystals whose $d_{002}$ (interlayer spacing) based on a diffraction line is less than 0.34 nm and whose crystallite size $Lc_{002}$ is adjusted to a size larger than 30 nm, intercalation occurs in the fluorine compound atmosphere. The intercalation increases the periodic distance and destroys the crystal structure. When adopting, for synthesizing a fluorine-containing material, an electrode made by coating the carbonaceous substrate with a conductive diamond, the electrolyte is infiltrated and causes peeling of the conductive diamond. For this reason, stable electrolysis for synthesizing a fluorine compound is not continued for a long time.

The method of forming the conductive diamond thin film on the substrate is not particularly limited, and any given method is adoptable. Examples of typical method includes a hot-filament CVD (chemical vapor deposition) method, a micro plasma CVD method, a plasma arc-jet method, and a physical vapor deposition (PVD) method, or the like.

To synthesize conductive diamond, the following materials are used as the raw materials of diamond in any of the above methods: a hydrogen gas or a rare gas such as He, Ar, and Ne which are an inert gas, and a mix gas serving as a carbon source presented as radicals in the gas. To provide electric conductivity to the diamond, one or both of a p-type dopant and an n-type dopant is/are added as the inert gas. A preferable p-type dopant is a boron, and a preferable n-type dopant is nitrogen or phosphorous. In any case, the content of the dopant in the conductive diamond is preferably not more than 100,000 ppm.

Regardless of the method for manufacturing the conductive diamond, the conductive diamond is preferably polycrystal. For example, the diamond thin film contains amorphous carbon, a graphite component, or nano crystal diamond. These components are confirmed by Raman spectroscopic analysis. Where: I (Dia) is the intensity of C-C stretch mode for $SP^3$ bonding which is characteristic in diamond; I (D-band) is the peak intensity nearby 1350 $cm^{-1}$ (between 1340 and 1380 $cm^{-1}$) which belongs to the D band of amorphous carbon; and I (G-band) is the peak intensity nearby 1580 $cm^{-1}$ (between 1560 and 1600 $cm^{-1}$) which belongs to the G band of the graphite component, the ratio I (Dia)/I (D-band) is 1 or more, and the ratio I (Dia)/I (G-band) is 1 or more. Further, the content of diamond is preferably more than the content of amorphous carbon or that of the graphite component. Use of such a conductive diamond improves the characteristics of electrolysis.

The conductive diamond thin film is 0.5 to 10 μm in film thickness, and the rate of the conductive diamond coating on the carbonaceous substrate is 10% or more. The film thickness of the conductive diamond thin film may vary approximately ±0.5 μm at the time of film formation. Therefore, to achieve the rate of conductive diamond coating of 10% or more, the average film thickness of the conductive diamond thin film is preferably 0.5 μm or more. Use of an electrode whose diamond coating rate is less than 10% in electrolysis will result in the same limit electric current density and life as those in cases where only a carbon substrate is used in the electrolysis. Further, if the film thickness of the conductive diamond thin film surpasses 10 μm, an internal stress is generated in the diamond thin film. This internal stress causes cracking or peeling. Even if no peeling occurs, the resistance of the electrode will significantly increases. Note that the average film thickness of the conductive diamond thin film is preferably 0.5 to 5 μm, and more preferably 0.5 to 3 μm. The diamond coating rate is preferably 50% or more.

EXAMPLES

With reference to examples and comparative examples, the following further details the present invention. However, the scope of the present invention is not limited to the examples below. First detailed are examples in relation to the carbonaceous substrate.

Example 1

Using mesophase microbeads as the filler, a carbonaceous substrate of an isotropic carbon material was manufactured through a cold isostatic pressing method. In an X-ray diffraction pattern of the carbonaceous substrate which was an isotropic carbon material, (002) diffraction lines between 2θ=10° and 2θ=30° had an asymmetric shape. Further, based on the diffraction lines in the X-ray diffraction pattern of this carbonaceous substrate, the periodic distances $d_{002}$ (interlayer spacing) of the carbonaceous substrate were 0.356 nm and 0.339 nm, the crystallite sizes ($Lc_{002}$) were 2 nm and 3 nm, the pore diameter was 0.26 μm, the open porosity was 9 volume %, and the bending strength was 103 MPa. The weight of the carbonaceous substrate increased by 0.7 mass %, after the carbonaceous substrate was exposed to $F_2$/HF gas for 96 hours, at 60° C. The weight further increased by 5.2 mass % after 1008 hours of the exposure. The weight further increased by 6.8 mass % after 1464 hours of the exposure. The substrate exposed to the $F_2$/HF gas was subjected to the X-ray diffraction analysis. As a result, formation of GIC (abbrv. of graphite intercalation compound) by fluorine ion was confirmed.

Example 2

Using mesophase microbeads as the filler, a carbonaceous substrate of an isotropic carbon material was manufactured through a cold isostatic pressing method. In an X-ray diffraction pattern of the carbonaceous substrate which was an isotropic carbon material, (002) diffraction lines between 2θ=10° and 2θ=30° had an asymmetric shape. Further, based on the diffraction lines in the X-ray diffraction pattern of this carbonaceous substrate, the periodic distances $d_{002}$ (interlayer spacing) of the carbonaceous substrate were 0.350 nm and 0.344 nm, the crystallite sizes ($Lc_{002}$) were 3 nm and 5 nm, the pore diameter was 0.22 μm, the open porosity was 12 volume %, and the bending strength was 75 MPa. The weight of the carbonaceous substrate increased by 0.1 mass, after the carbonaceous substrate was exposed to $F_2$/HF gas for 96 hours, at 60° C. The weight further increased by 4.9 mass % after 1008 hours of the exposure. The weight further increased by 5.7 mass % after 1464 hours of the exposure. The substrate exposed to the $F_2$/HF gas was subjected to the X-ray diffraction analysis. As a result, formation of GIC (abbrv. of graphite intercalation compound) caused by the intercalation of fluorine ion was confirmed.

Example 3

Using mesophase microbeads as the filler, a carbonaceous substrate of an isotropic carbon material was manufactured through a cold isostatic pressing method. In an X-ray diffraction pattern of the carbonaceous substrate which was an isotropic carbon material, (002) diffraction lines between 2θ=10° and 2θ=30° had an asymmetric shape. Further, based on the diffraction lines in the X-ray diffraction pattern of this carbonaceous substrate, the periodic distances $d_{002}$ (interlayer spacing) of the carbonaceous substrate were 0.356 nm and 0.330 nm, the crystallite sizes ($Lc_{002}$) were 2 nm and 3 nm, the pore diameter was 0.26 μm, the open porosity was 9 volume %, the electric resistance was 46.7 μΩ·m, and the bending strength was 103 MPa. This carbonaceous substrate was used as an anode in a molten-salt of KF-2HF immediately after the initial make-up of electrolytic bath. A nickel plate was used as a cathode material. The electric current density was varied to study the limit electric current density. The limit electric current density was 34.8 A/dm$^2$ in the molten-salt of KF-2HF with the water content of 200 ppm or less, and was 24.0 A/dm$^2$ in the molten-salt of KF-2HF with the water content of 500 ppm.

Example 4

Using mesophase microbeads as the filler, a carbonaceous substrate of an isotropic carbon material was manufactured through a cold isostatic pressing method. In an X-ray diffraction pattern of the carbonaceous substrate which was an isotropic carbon material, (002) diffraction lines between 2θ=10° and 2θ=30° had an asymmetric shape. Further, based on the diffraction lines in the X-ray diffraction pattern of this carbonaceous substrate, the periodic distances $d_{002}$ (interlayer spacing) of the carbonaceous substrate were 0.350 nm and 0.344 nm, the crystallite sizes ($Lc_{002}$) were 3 nm and 5 nm, the pore diameter was 0.22 μm, the open porosity was 12 volume %, the electric resistance was 26.4 μΩ·m, and the bending strength was 75 MPa. This carbonaceous substrate was used as an anode in a molten-salt of KF-2HF immediately after the initial make-up of electrolytic bath. A nickel plate was used as a cathode material. The electric current density was varied to study the limit electric current density. The limit electric current density was 32.8 A/dm$^2$ in the molten-salt of KF-2HF with the water content of 200 ppm or less, and was 10.2 A/dm$^2$ in the molten-salt of KF-2HF with the water content of 500 ppm.

Comparative Example 1

Using mesophase microbeads as the filler, a carbonaceous substrate of an isotropic carbon material was manufactured through a cold isostatic pressing method. In an X-ray diffraction pattern of the carbonaceous substrate which is an isotropic carbon material, (002) diffraction lines between 2θ=10° and 2θ=30° form an asymmetric shape. The presence area of a diffraction line whose center was at 2θ=26° was approximately 49% of the total surficial area of the asymmetric shape formed by the (002) diffraction lines. Further, based on the diffraction lines in the X-ray diffraction pattern of this carbonaceous substrate, the periodic distance $d_{002}$ (interlayer spacing) of the carbonaceous substrate was 0.339 nm, the crystallite size ($Lc_{002}$) was 23 nm, the pore diameter was 0.22 μm, the open porosity was 15 volume %, and the bending strength was 93 MPa. This carbonaceous substrate was exposed to $F_2$/HF gas for 96 hours, at 60° C. The weight increased by 0.1 mass %. The weight further increased by 15.2 mass % after 1008 hours of the exposure. Further examination was intended; however, the carbonaceous substrate cracked. Cracking of the substrate was found to take place, after 1104 hours of exposure to $F_2$/HF gas and when the weight increases by more than 10 mass %. From this finding and from Examples 1 and 2, it was understood that the interlayer spacing $d_{002}$ based on the X-ray diffraction pattern needs to be 0.34 nm or more.

Comparative Example 2

Using mesophase microbeads as the filler, a carbonaceous substrate of an isotropic carbon material was manufactured through a cold isostatic pressing method. In an X-ray diffraction pattern of the carbonaceous substrate which was an isotropic carbon material, (002) diffraction lines between 2θ=10° and 2θ=30° had an asymmetric shape. Further, based on the diffraction lines in the X-ray diffraction pattern of this carbonaceous substrate, the periodic distance $d_{002}$ (interlayer spacing) of the carbonaceous substrate was 0.339 nm, the crystallite size ($Lc_{002}$) was 62 nm, the pore diameter was 0.22 μm, the open porosity was 15 volume %, the electric resistance was 15.5 μΩ·m, and the bending strength was 93 MPa. This carbonaceous substrate was used as an anode in a molten-salt of KF-2HF immediately after the initial make-up of electrolytic bath. A nickel plate was used as a cathode material. The electric current density was varied to study the limit electric current density. The limit electric current density was inferior to that of Example 3, and was 29.8 A/dm$^2$ in the molten-salt of KF-2HF with water content of 200 ppm or less and 8.3 A/dm$^2$ with the water content of 500 ppm. From this finding, it is understood that the limit electric current density drops when the interplanar spacing $d_{002}$ based on the X-ray diffraction pattern drops to 0.34 nm or less.

Comparative Example 3

A carbonaceous substrate made of an isotropic carbon material was manufactured through a cold isostatic pressing method using petroleum coke and a pulverized graphite product. In an X-ray diffraction pattern of the carbonaceous substrate which is an isotropic carbon material, (002) diffraction lines between 2θ=10° and 2θ=30° form an asymmetric shape. The presence area of a diffraction line whose center was at 2θ=26° was approximately 20% of the total surficial area of the asymmetric shape formed by the (002) diffraction lines. Further, based on the diffraction lines in the X-ray diffraction pattern of this carbonaceous substrate, the periodic distance $d_{002}$ (interlayer spacing) of the carbonaceous substrate was 0.337 nm, the crystallite size was 37 nm, and the bending strength was 43 MPa. This carbonaceous substrate was used as an anode in a molten-salt of KF-2HF immediately after the initial make-up of electrolytic bath. A nickel plate was used as a cathode material. Then, constant current electrolysis was performed with the electric current density of 20 A/dm$^2$. The electrode cracked within 24 hours of electrolysis, and the electrolysis was no longer possible.

Comparative Example 4

A glasslike carbonaceous substrate was manufactured by using phenol resin. In an X-ray diffraction pattern of the glasslike carbonaceous substrate, (002) diffraction lines between 2θ=10° and 2θ=30° had a symmetric shape. The presence proportion of the diffraction line whose center was at 2θ=26° was 0% of the total surficial area of the symmetric shape formed by the (002) diffraction lines between 2θ=10° and 2θ=30°. With the glasslike carbonaceous substrate, there was prepared a carbonaceous substrate wherein, based on a diffraction line in an X-ray diffraction pattern thereof, the interlayer spacing $d_{002}$ was 0.350 nm, the crystallite size ($Lc_{002}$) was 2 nm, and the open porosity was 5 volume % or less. This carbonaceous substrate was used as an anode in a molten-salt of KF-2HF immediately after the initial make-up of electrolytic bath. A nickel plate was used as a cathode material. The electric current density was varied to study the limit electric current density. Polarization occurred immediately after the current was applied, and the voltage had excessively increased and the electrolysis was no longer possible.

Next, the following details in the case of using of the electrode for fluorine electrolysis, which is coated a diamond thin film on carbonaceous substrate.

Example 5

Adopting mesophase microbeads as the filler, a carbonaceous substrate was fabricated through a cold isostatic pressing method. In an X-ray diffraction pattern of the carbonaceous substrate, (002) diffraction lines between 2θ=10° and 2θ=30° had an asymmetric shape. The presence area of the diffraction line whose center was at the 2θ=26° was 57% of a total surficial area of the (002) diffraction lines between 2θ=10° and 2θ=30°. Based on the diffraction line resulting from the X-ray diffraction analysis, the periodic distances $d_{002}$ (interlayer spacing) of the carbonaceous substrate were 0.355 nm and 0.339 nm, the crystallite sizes were 2 nm and 3 nm, the pore diameter was 0.26 μm, and the open porosity was 9 volume %. The physical properties of the carbonaceous substrate were as follows. Namely, the CTE (thermal expansion coefficient) was 6.4 to $6.8\times10^{-6}$/K, the electric resistance was 46.7 μΩ·m, and the bending strength was 103 MPa. In a chamber, the carbonaceous substrate was brought into contact with a mix gas prepared by adding 1 vol % of methane gas and 0.5 ppm of trimethyl boron gas to hydrogen gas. While maintaining the pressure inside the chamber at 75 Torr, the power was applied to a filament inside the chamber to raise the temperature to 2400° C. so that the temperature of the substrate is 860° C. Then, through a CVD method, the carbonaceous substrate was coated with conductive diamond, to obtain an electrode of Example 5 according to the present invention, for use in a fluorine-producing electrolysis. The film thickness of the diamond thin film of the electrode for use in the fluorine-producing electrolysis was 3 μm. Further, from the X-ray diffraction analysis, deposited thin film was confirmed diamonds. The lattice constant of the diamond was 0.3568 nm. In Raman spectroscopic analysis, there is confirmed a diamond-attributed peak of 41.9 $cm^{-1}$ which is the full width at half maximum of the peak at 1333.7 $cm^{-1}$ of the C-C stretch mode of $SP^3$ bonding.

The electrode for fluorine-producing electrolysis manufactured in Example 5 was used as an anode in a molten-salt of KF-2HF immediately after the initial make-up of electrolytic bath. A nickel plate was used as a cathode material. Then, constant current electrolysis was performed with the electric current density of 20 A/$dm^2$. The cell voltage was 5.6 V, after 24 hours of the electrolysis. The electrolysis was continued. The cell voltage was 5.6 V after another 24 hours of the electrolysis. Analyzing the gas generated at the anode, it is found that the generated gas was $F_2$, and that the amount of gas generated (generation efficiency) accounts 98% of the theoretical amount of gas generated for the quantity of electricity consumed. Further, no change was observed between the cell voltage 24 hours after the start of charging and the cell voltage after another 24 hours. From these results, it is assumed that the electrolysis was smoothly performed without polarization of the electrode.

The surface energy was calculated from the contact angle of water and methylene iodide with respect to the portion of the electrode for fluorine-producing electrolysis before being used in the electrolysis, which portion is coated by the conductive polycrystal diamond. As a result, the surface energy was 40.1 mN/m. The surface energy of a portion not having the diamond structure was 41.5 dmNm. The electrode for fluorine-producing electrolysis was used as an anode in a molten-salt of KF-2HF immediately after the initial make-up of electrolytic bath. A nickel plate was used as a cathode material. Then, constant current electrolysis was performed with the electric current density of 100 A/$dm^2$. The cell voltage was 5.5 V, after 24 hours of the electrolysis. The electrolysis was continued. The cell voltage was 5.5V after another 24 hours of the electrolysis. Analyzing the gas generated at the anode, it is found that the gas generated was fluorine ($F_2$), and that the generation efficiency was 98%. The electrolysis was further continued with the electric current density of 100 A/$dm^2$, and then stopped after another 24 hours. The electrode was then taken out, and washed with anhydrous hydrogen fluoride. Then, the surface energy was calculated through the same method used before the electrolysis. The surface energy of the portion coated by the conductive polycrystal diamond was 38.0 mN/m, and the surface energy of the portion not coated by the conductive polycrystal diamond was 3.5 mN/m. From these results, it is found that the conductive diamond portion was stable in the fluorine containing electrolysis synthesis, while the portion having no diamond structure was fluorinated and was electrochemically inactive with the formation of the insulation coating.

Example 6

Using mesophase microbeads as the filler, a carbonaceous substrate of an isotropic carbon material was manufactured through a cold isostatic pressing method. In an X-ray diffraction pattern of the carbonaceous substrate which is an isotropic carbon material, (002) diffraction lines between 2θ=10° and 2θ=30° had an asymmetric shape. The presence area of the diffraction line whose center was at the 2θ=26° was 57% of a total surficial area of the (002) diffraction lines between 2θ=10° and 2θ=30°. Based on the diffraction line resulting from the X-ray diffraction analysis, the periodic distances $d_{002}$ (interlayer spacing) of the carbonaceous substrate were 0.355 nm and 0.340 nm, the crystallite sizes were 2 nm and 3 nm, the pore diameter was 0.26 μm, and the open porosity was 9 volume %. The physical properties of the carbonaceous substrate were as follows. Namely, the CTE (Coefficient of Thermal Expansion) was 6.4 to $6.8\times10^{-6}$/K, the electric resistance was 46.7 μΩ·m, and the bending strength was 103 MPa. Ina chamber, the carbonaceous substrate was brought into contact with a mix gas prepared by adding 1 vol % of methane gas and 0.5 ppm of tri methyl boron gas to hydrogen gas. While maintaining the pressure inside the chamber at 75 Torr, the power was applied to a filament inside the chamber to raise the temperature to 2400° C. so that the temperature of the substrate is 860° C. Then, through a CVD method, the carbonaceous substrate was coated with conductive diamond, to obtain an electrode of Example 6 according to the present invention, for use in a fluorine-producing electrolysis. The film thickness of the diamond thin film of the electrode for fluorine-producing electrolysis was 0.6 μm in average. From the observation of the cross section, the film thickness was found to be ±0.5 to 1 μm. Further, from the X-ray diffraction analysis, deposition of diamond was confirmed. The lattice constant of the diamond was 0.3568 nm. In Raman spectroscopic analysis, there is confirmed a diamond-attributed peak of 41.9 $cm^{-1}$ which is the full width at half maximum of the peak at 1333.7 $cm^{-1}$ of the C-C stretch mode of $SP^3$ bonding. When the G-band and D-band were compared, the strength ratio was 1 or higher.

The electrode for fluorine-producing electrolysis manufactured in Example 6 was used as an anode in a molten-salt of KF-2HF immediately after the initial make-up of electrolytic bath. A nickel plate was used as a cathode material. Then, constant current electrolysis was performed with the electric current density of 20 A/$dm^2$. The cell voltage was 5.5 V, after 24 hours of the electrolysis. The electrolysis was continued. The cell voltage was 5.5V after another 24 hours of the electrolysis. The gas generated at this time was $F_2$gas, and the generation efficiency was 98%. Further, no change was observed between the cell voltage 24 hours after the start of charging and the cell voltage after another 24 hours. From these results, it is assumed that the electrolysis was smoothly performed without polarization of the electrode.

Example 7

An electrode of Example 7 for fluorine-producing electrolysis was obtained in the same way as the electrode of Example 6, except in that the period for CVD was extended and the film thickness of the diamond thin film was made 10 μm. Further, from the X-ray diffraction analysis, deposition of diamond was confirmed, for the electrode of Example 7 for fluorine-producing electrolysis too. The lattice constant of the diamond was 0.3568 nm. In Raman spectroscopic analysis, there is confirmed a diamond-attributed peak of 41.9 $cm^{-1}$ which is the full width at half maximum of the peak at 1333.7 $cm^{-1}$ of the C-C stretch mode of $SP^3$ bonding. When the G-band and D-band were compared, the strength ratio was 1 or higher.

The electrode for fluorine-producing electrolysis manufactured in Example 7 was used as an anode in a molten-salt of KF-2HF immediately after the initial make-up of electrolytic bath. A nickel plate was used as a cathode material. Then, constant current electrolysis was performed with the electric current density of 20 $A/dm^2$. As in Example 6, the cell voltage was 5.5 V, after 24 hours of the electrolysis. The electrolysis was continued. The cell voltage was 5.5V after another 24 hours of the electrolysis. The gas generated at this time was $F_2$ gas, and the generation efficiency was 98%. Further, no change was observed between the cell voltage 24 hours after the start of charging and the cell voltage after another 24 hours. From these results, it is assumed that the electrolysis was smoothly performed without polarization of the electrode.

Comparative Example 5

On a carbonaceous substrate mentioned in Comparative Example 4, a diamond thin film of 3 μm in film thickness was formed with the same conditions as those in Example 6. The adhesiveness of the diamond to the carbonaceous substrate was significantly weak. The electrode for fluorine-producing electrolysis was used as an anode in a molten-salt of KF-2HF immediately after initial make-up of electrolytic bath. A nickel plate was used as a cathode material. The electric current density was varied to study the limit of the electric current density. The diamond thin film peeled and polarization occurred, and the voltage increased excessively. The electrolysis was therefore no longer possible.

Comparative Example 6

An electrode of Comparative Example 6 for fluorine-producing electrolysis was obtained in the same way as the electrode of Example 6, except in that the period for CVD was shortened and the film thickness of the diamond thin film was made 0.4 μm. The diamond thin film of the electrode of Comparative Example 6 for fluorine-producing electrolysis was subjected to Raman spectroscopic analysis. The full width at half maximum of the peak in the C-C stretch mode of the $SP^3$ bonding which is a characteristic of diamond was 100 $cm^{-1}$. The intensity ratio of intensity I (Dia) to the G-band and D-band attributed to the graphite component was less than 1. From these results, it is supposed that the carbonaceous substrate was not sufficiently coated with the diamond thin film.

Comparative Example 7

An electrode of Comparative Example 7 for fluorine-producing electrolysis was obtained in the same way as the electrode of Example 6, except in that the period for CVD was extended and the film thickness of the diamond thin film was made 11 μm. Further, from the X-ray diffraction analysis, deposition of diamond was confirmed, for the electrode of Comparative Example 7 for fluorine-producing electrolysis too. The lattice constant of the diamond was 0.3568 nm. In Raman spectroscopic analysis, there is confirmed a diamond-attributed peak of 41.9 $cm^{-1}$ which is the full width at half maximum of the peak at 1333.7 $cm^{-1}$ of the C-C stretch mode of $SP^3$ bonding.

However, the thin film cracked and peeled off from the carbonaceous substrate, due to the stress applied when the electrode of Comparative Example 7 for fluorine-producing electrolysis was taken out from the synthesizing apparatus. Thus, electrode of Comparative Example 7 was not usable as an electrode.

Table 1 indicates the results of Examples 1 to 7 and Comparative Examples 1 to 7.

TABLE 1

| | Diamond Coating | Thickness of Conductive diamond film (μm) | Shape of (002) diffraction lines | presence area of (002) diffraction lines with their centers at 2θ = 26° VS. total surficial area of the (002) diffraction lines between 2θ = 10° and 2θ = 30° | interlayer spacing $d_{002}$ based on diffraction lines (nm) | | Crystallite sizes ($Lc_{0002}$) (nm) | |
|---|---|---|---|---|---|---|---|---|
| Example 1 | No | — | Asymmetrical | — | 0.356 | 0.339 | 2 | 3 |
| Example 2 | No | — | Asymmetrical | — | 0.350 | 0.344 | 3 | 5 |
| Example 3 | No | — | Asymmetrical | — | 0.356 | 0.330 | 2 | 3 |
| Example 4 | No | — | Asymmetrical | — | 0.350 | 0.344 | 3 | 5 |
| Example 5 | Yes | 3 | Asymmetrical | 57% | 0.355 | 0.339 | 2 | 3 |
| Example 6 | Yes | 0.6 | Asymmetrical | 57% | 0.335 | 0.340 | 2 | 3 |
| Example 7 | Yes | 10 | Asymmetrical | 57% | 0.335 | 0.340 | 2 | 3 |
| Comparative Example 1 | No | — | Asymmetrical | 49% | 0.339 | — | 23 | — |
| Comparative Example 2 | No | — | Asymmetrical | — | 0.339 | — | 62 | — |
| Comparative Example 3 | No | — | Asymmetrical | 20% | 0.337 | — | 37 | — |
| Comparative Example 4 | No | — | Symmetrical | 0% | 0.350 | — | 2 | — |

TABLE 1-continued

| | | | | | | | | |
|---|---|---|---|---|---|---|---|---|
| Comparative Example 5 | Yes | 3 | Symmetrical | 0% | 0.350 | 0.334 or more | 2 | — |
| Comparative Example 6 | Yes | 0.4 | Asymmetrical | 57% | 0.335 | 0.340 | 2 | 3 |
| Comparative Example 7 | Yes | 11 | Asymmetrical | 57% | 0.335 | 0.340 | 2 | 3 |

| | Pore diameters (μm) | Open porosity (vol. %) | Bending strength (MPa) | Electric resistance (μΩ · m) | Weight increase rate after exposure of $F_2HF$ | Electrolysis in KF-2HF |
|---|---|---|---|---|---|---|
| Example 1 | 0.26 | 9 | 103 | — | 0.7%, after 96 hrs.<br>5.2% after 1008 hrs.<br>6.8% after 1464 hrs. | — |
| Example 2 | 0.22 | 12 | 75 | — | 0.1%, after 96 hrs.<br>4.9% after 1008 hrs.<br>5.7% after 1464 hrs. | — |
| Example 3 | 0.26 | 9 | 103 | 46.7 | — | (Water Content)<br>200 ppm: 34.8 A/dm$^2$<br>500 ppm: 24.0 A/dm$^2$ |
| Example 4 | 0.22 | 12 | 75 | 26.4 | — | (Water Content)<br>200 ppm: 32.8 A/dm$^2$<br>500 ppm: 10.2 A/dm$^2$ |
| Example 5 | 0.26 | 9 | 103 | 46.7 | — | — |
| Example 6 | 0.26 | 9 | 103 | 46.7 | — | — |
| Example 7 | 0.26 | 9 | 103 | 46.7 | — | — |
| Comparative Example 1 | 0.22 | 15 | 93 | — | Significantly increased | — |
| Comparative Example 2 | 0.22 | 15 | 93 | 15.5 | — | (Water Content)<br>200 ppm: 34.8 A/dm$^2$<br>500 ppm: 10.2 A/dm$^2$ |
| Comparative Example 3 | — | — | 43 | — | — | Electrode cracked after 24 hours |
| Comparative Example 4 | — | 5 or less | — | — | — | Polarized immediately |
| Comparative Example 5 | — | 5 or less | — | — | — | Thin film peeled immediately after electrolysis started |
| Comparative Example 6 | 0.26 | 9 | 103 | 46.7 | — | — |
| Comparative Example 7 | 0.26 | 9 | 103 | 46.7 | Thin film broke when taken out from apparatus | — |

Embodiment and Examples of an electrode for fluorine-producing electrolysis according to the present invention were thus described above. It is however obvious that the present invention is not limited to the above embodiment and examples, and may be altered in various ways within the scope of claims set forth hereinbelow.

The invention claimed is:

1. An electrode suitable for fluorine-producing electrolysis, comprising a carbonaceous substrate and a conductive diamond thin film formed on the carbonaceous substrate, wherein:

an X-ray diffraction pattern of the carbonaceous substrate is a complex profile and includes at least two (002) diffraction lines; and the substrate comprises crystallites with different interlayer spacings.

2. The electrode according to claim 1, wherein the carbonaceous substrate is such that presence area of the diffraction line whose center is at the 2θ=26° is 30% or more of a total surficial area of the (002) diffraction lines between 2θ=10° and 2θ=30°.

3. The electrode according to claim 1, wherein the carbonaceous substrate comprises crystals wherein the periodic distance $d_{002}$ is 0.34 nm or more and the crystallite size $Lc_{002}$ is 20 nm or less based on the X-ray diffraction lines.

4. The electrode according to claim 1, wherein the carbonaceous substrate is an isotropic carbon material.

5. The electrode according to claim 1, wherein the carbonaceous substrate comprises mesophase microbeads as filler thereof.

6. The electrode according to claim 1, wherein the open porosity of the carbonaceous substrate is 5 to 30 volume %.

7. The electrode according to claim 1, wherein:

the conductive diamond thin film comprises boron as a p-type dopant and nitrogen or phosphorous as an n-type dopant; and the content of the p-type dopant and/or the n-type dopant is not more than 100,000 ppm.

8. The electrode according to claim 7, wherein 10% or more of the surface of the carbonaceous substrate is coated with the conductive diamond thin film.

9. The electrode according to claim 7, wherein the crystallinity of the conductive diamond thin film is such that the lattice constant derived from the X-ray diffraction is 0.357 nm or less, and in Raman spectrum resulted from Raman spectroscopic analysis, the full width at half maximum of a peak between 1320 and 1340 cm$^{-1}$ of the C-C stretch mode of $SP^3$ bonding is 100 cm$^{-1}$ or less.

10. The electrode according to claim 1, wherein a film thickness of the conductive diamond thin film is from 0.5 μm to 10 μm.

11. The electrode according to claim 1, wherein 10% or more of the surface of the carbonaceous substrate is coated with the conductive diamond thin film.

12. The electrode according to claim 1, wherein the crystallinity of the conductive diamond thin film is such that the lattice constant derived from the X-ray diffraction is 0.357 nm or less, and in Raman spectrum resulted from Raman spectroscopic analysis, the full width at half maximum of a peak between 1320 and 1340 $cm^{-1}$ of the C-C stretch mode of $SP^3$ bonding is 100 $cm^{-1}$ or less.

13. An electrode suitable for fluorine-producing electrolysis, comprising a carbonaceous substrate, wherein in an X-ray diffraction pattern of the carbonaceous substrate, (002) diffraction lines between $2\theta=10°$ and $2\theta=30°$ have an asymmetric shape; and the X-ray diffraction pattern includes at least two pattern components which are a diffraction line whose center is at $2\theta=26°$ and a diffraction line whose center is at a lower angle than $2\theta=26°$.

* * * * *